US005605393A

United States Patent [19]

Cucchi et al.

[11] Patent Number: 5,605,393

[45] Date of Patent: Feb. 25, 1997

[54] TABLE WITH LIGHT EMITTING PLANE FOR TREATMENT OF PETS

[76] Inventors: Massimo Cucchi, ia Achille Grandi 1, Albinea (RE), Italy, 42020; Oscar Ripamonti, Via D.C.Cazzaniga 9, Albinea (CO), Italy, 22055; Ivo Zapparoli, Via F.Parri 2, Carpi, Italy, 41012

[21] Appl. No.: 254,185

[22] Filed: Jun. 6, 1994

[30] Foreign Application Priority Data

Jun. 7, 1993 [IT] Italy ..... 93A000051

[51] Int. Cl.[6] ..... F21V 33/00

[52] U.S. Cl. ..... 362/97; 362/127; 362/133; 362/294; 362/373; 108/23

[58] Field of Search ..... 362/96, 97, 127, 362/130, 804, 155, 276, 267, 156, 373, 294, 310, 293, 84, 311, 307, 240, 241; 108/23

[56] References Cited

U.S. PATENT DOCUMENTS

| | | | |
|---|---|---|---|
| 2,701,838 | 2/1955 | Loesch | 362/97 |
| 3,802,102 | 4/1974 | Licciardi | 362/97 |
| 4,404,619 | 9/1983 | Fergusor | 362/97 X |
| 4,418,378 | 11/1983 | Johnson | 362/97 |
| 4,564,886 | 1/1986 | Morcheles | 362/97 |
| 4,602,448 | 7/1986 | Grove | 362/97 |
| 4,631,643 | 12/1986 | Koster | 362/97 |
| 4,843,524 | 6/1989 | Krent et al. | 362/127 |
| 4,862,337 | 8/1989 | Ohshio et al. | 362/294 |
| 4,943,689 | 7/1990 | Siefer et al. | 362/97 X |
| 5,032,957 | 7/1991 | Canfield | 362/155 X |
| 5,041,949 | 8/1991 | Hirota et al. | 362/294 X |
| 5,083,241 | 1/1992 | Foster | 362/127 X |
| 5,207,495 | 5/1993 | Ahlstone | 362/97 X |
| 5,379,540 | 1/1995 | Howard | 362/226 X |

FOREIGN PATENT DOCUMENTS

| | | | |
|---|---|---|---|
| 531441 | 11/1957 | Belgium | 362/127 |

*Primary Examiner*—Ira S. Lazarus
*Assistant Examiner*—Thomas M. Sember
*Attorney, Agent, or Firm*—Jennifer K. Farrar

[57] ABSTRACT

Table provided with a light emitting plane, for the treatment of pets. The invention includes a light emitting panel formed of a box-like structure, including a light emitting source, a cover for coloring the light; reflecting and diffusing surfaces for reflecting and diffusing the light, a photoelectric device for varying the intensity of the light and a removable cover. The invention also includes a support structure and a device for adjusting a height of the panel.

18 Claims, 5 Drawing Sheets

TABLE WITH LIGHT EMITTING PLANE FOR TREATMENT OF PETS

BACKGROUND OF THE INVENTION

The present invention relates to a device having as main objects:

a) To illuminate the parts of the animal's body to be treated, which usually are in shadow due to the overall illumination of the environment;

b) To provide one or more tonalities of colored light so that the contrast with respect to the color of the animal's fur will allow to perceive even a single hair;

c) To allow the variation of the light intensity of the panel in order to adapt it to the environment's illumination, so that both the time interval required by the operator's eye to perceive the presence of objects (perception rapidity), and the capability of recognizing the smallest details, remain satisfactory (vision's sharpness);

d) To support the weight of the animal and to prevent damage-of the light-emitting panel and/or of the operator or the animal, due to ejection of urine.

In the specific field involving the treatment of animals, in particular cats and dogs, there exist simple tables characterized by a plane onto which the animal is laid as shown in FIG. 1. Said tables may be of fixed or adjustable in height, as shown in FIG. 2. There are tables having a plane with a rectangular shape and tables having a plane with a circular shape, the latter ones generally have a rotatable plane. There do not exist, until now, tables having a plane which consists of a light-emitting panel.

In other industrial fields, as for example hospital's X-ray photography rooms; photographic laboratories and technical design bureaus, there are used light emitting panels in the form of wall panels. The panels may also be horizontal or orientable, they may be supported by tripods, and they have in any case the function of permitting the vision of an X-ray photograph, a slide; a drawing; etc. In any case, said light emitting panels emit white light. Only if they are employed in photographic development laboratories will they emit colored light, in order to avoid to expose the film, in case it has not been already developed.

The primary object Of the present invention is to realize a light-emitting panel with one or more colorings, which is provided with a regulator of light intensity, which also has the function of supporting the animal in order to allow to execute on the same any operation concerned with the care of the animal such as shearing and coiffure, for example. Preventing fatiguing of the operator's eyes, the panel will allow work under perfect visibility conditions and perception of the smallest details as a result of the contrast between the color of the light emitted by the panel and the color of the animal's fur, and as a result of the possibility of adjusting the value of the light intensity of the panel itself.

The panel must also prevent urine which is possibly ejected by the animal, to cause damage to the panel, the operator or the animal itself, and it must be of a type which may be easily cleaned. Furthermore, the tables may comprise other additional features which are not provided by the tables of the art, and precisely including:

one or more drawers which contain the tools for the care of the animal;

a wrapping for the cable of the shearing machine (clipper) and a hook or support for the clipper; and doors in order to permit the access inside the bodywork.

Said panel may be realized and employed separately, by simply placing it on known tables. Alternatively, it may be incorporated with a supporting structure so as to constitute the supporting plane for the animal.

SUMMARY OF THE INVENTION

According to the present invention the above mentioned objects are attained by means of a device comprising a box-like part provided with a transparent or translucid removable cover, and on whose inside there are one or more light emitting points, which may also have different colors and an adequate electric circuit allowing both to switch on one or the other among the colored light sources, and to adjust their intensity.

In order that the invention be better understood, and in order to show further advantages, two embodiments thereof will now be described with reference to the annexed drawings which are given only for illustrative and non-limitative purposes.

DETAILED DESCRIPTION OF THE PREFERRED EMBODIMENTS

In the FIGS. 3 to 13 there is shown a first embodiment of the table provided with the light emitting plane of the present invention. In the different figures, the same alphanumeric reference signs indicate the same parts and elements.

Figure 1:
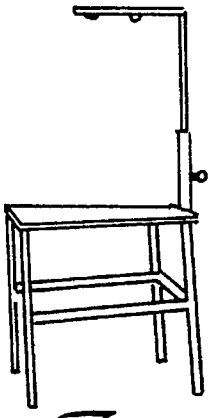
Fig. 1 PRIOR ART
FIG. 1 is a perspective view of a first known table of fixed height.
Figure 2:
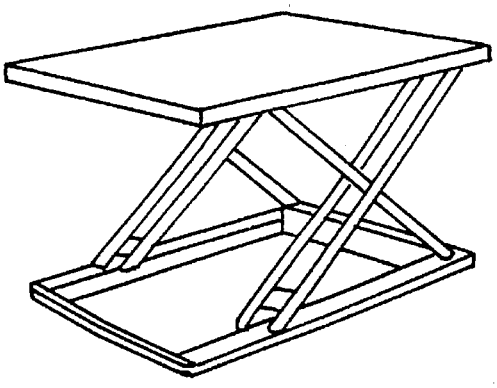
Fig. 2 PRIOR ART
FIG. 2 is a perspective view of a second known table of adjustable height.
Figure 3:
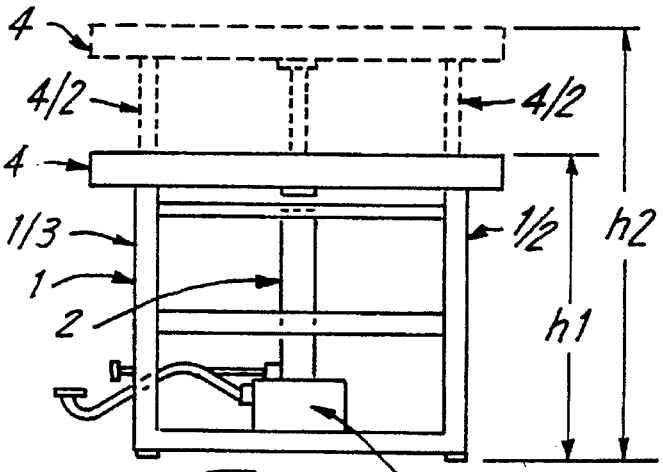
FIG. 3 is a side elevational view of a first preferred embodiment showing the structure of the table.
Figure 4:
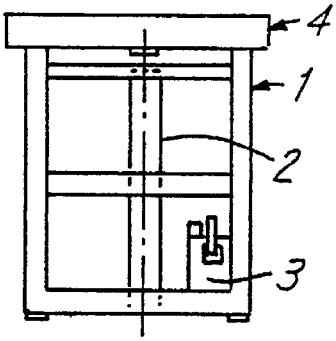
FIG. 4 is an end elevational view of a first preferred embodiment showing the structure of the table.
Figure 5:
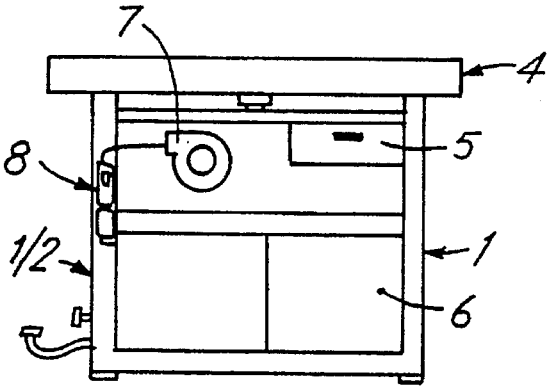
FIG. 5 is a side elevational view of the first preferred embodiment including the bodywork, the drawers, the doors and the wrapping for the cable of the clipper.

Making reference now to the FIGS. 3, 4 and 5, reference number 1 indicates a structure to which there is centrally mounted a linear pneumatic actuator 2 arranged vertically and operated by a manual pump 3 or automatically by means of a central control unit and respective control parts which are not shown. At the end of the rod of the actuator 2, there is assembled a light emitting panel 4 which is shown in FIGS. 6 to 13; therefore, by means of the actuator 2 it is possible to vary the height of the panel 4, with respect to the ground starting from a minimum value h1 until a maximum value h2 (shown in phantom in FIG. 3). In order to render more stable the panel 4, the structure 1 is formed by four tubular uprights 1/*a* along whose inside there are guided four telescoping columns 4/*a* which are integral with the light emitting panel 4. The pneumatic actuator 2 may be replaced by a mechanical actuator operated manually or by a motor; alternatively, it may be replaced by equivalent means having the function to lift and lower the light-emitting panel 4.

The structure 1, if it is perimetrically closed by means of panels, will allow the assembling of drawers 5 (shown in FIG. 5), and doors 6 in order to permit the access to the inside, and a wrapping 7 for the cable of the shearing machine 8, or clipper, which can be hooked to an upright 1/*a*.

Figure 7:
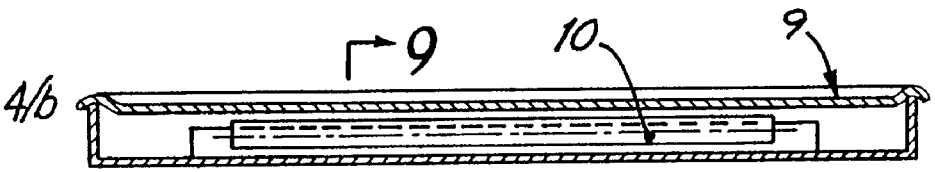
FIG. 7 is a cross-sectional of the light emitting panel of a preferred embodiment taken along line a—a as shown in FIG. 6.

The light emitting panel 4 as shown in FIGS. 6 through 13 is made up by a box like part 4/*b* provided with a cover 9; the latter is formed by a transparent or translucid material, and it is removable with respect to the box-like part 4/*b*. Said cover 9 may be simply supported or engaged as shown in FIG. 7, or it may be hinged or slipped in or out, for both purposes of allowing a quicker and easier access to the inside, in order to perform maintenance and cleaning operations, and also in order to facilitate cleaning of the cover.

Figure 8:
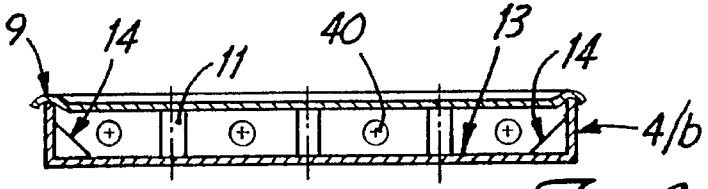
FIG. 8 is a cross-sectional view of a second preferred embodiment of the light emitting panel taken along line b—b as shown in FIG. 7.
Figure 6:
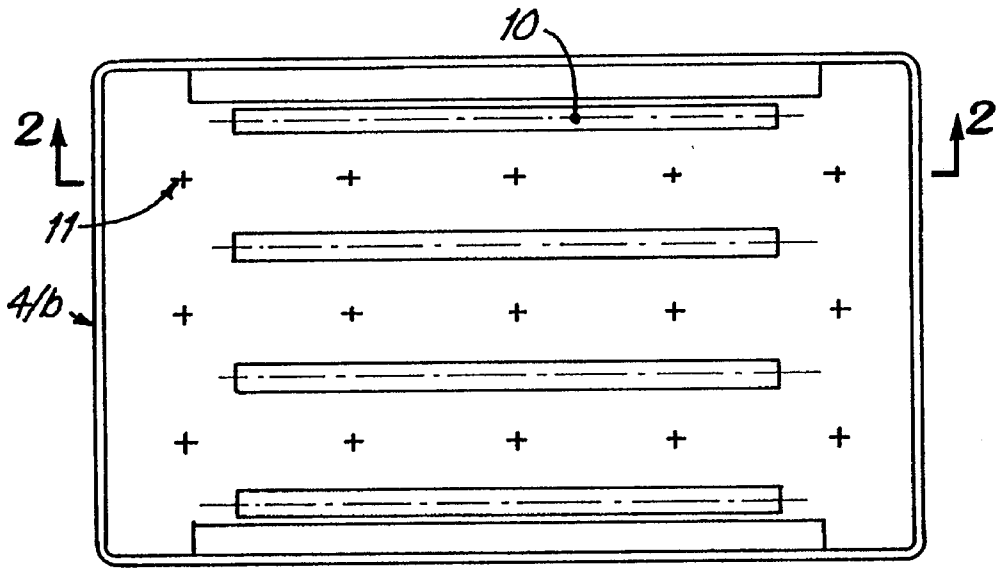
FIG. 6 is a top plan view of the light emitting panel of a preferred embodiment of the present invention, without a cover.

Said cover may be obtained from a plate capable of being deformed by heat and having a sufficiently great thickness in order to resist to the stresses due to the weight and to the movements of the animal which will be placed on it, or it will be supported by small columns or spacers 11, shown in FIGS. 6 and 8.

Figure 12:
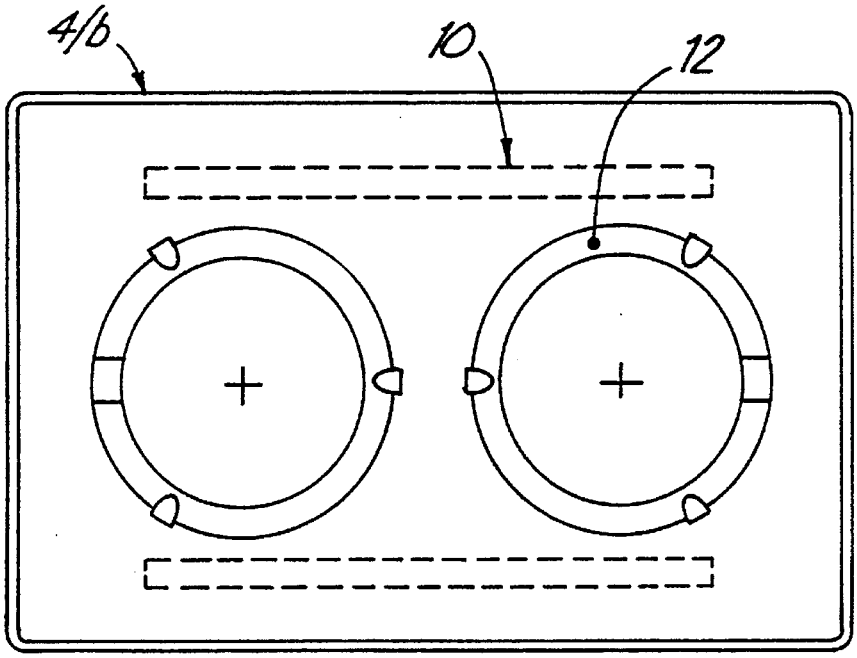
FIG. 12 is a top plan view of a light emitting panel of the present invention, showing two circular neon tubes.
Figure 13:
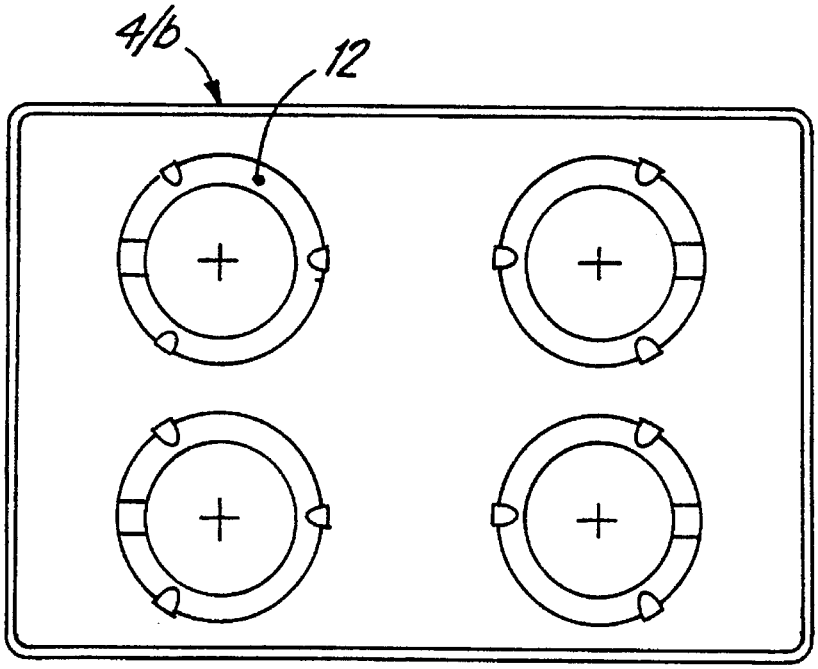
FIG. 13 is a top plan view of a light emitting panel of the present invention, showing an arrangement of four circular neon tubes.

The light emitting source may consist of linear fluorescent tubes or near neon tubes 10 (shown in FIGS. 6 through 11), or circular tubes 12 (shown in FIGS. 12 and 13, differently arranged. It may also consist of neon tubes with different configurations.

Figure 9:
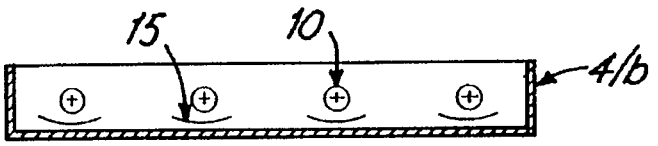
FIG. 9 is a cross-sectional view of a third preferred embodiment of .the light emitting panel taken along line b—b as shown in FIG. 7.
Figure 10:
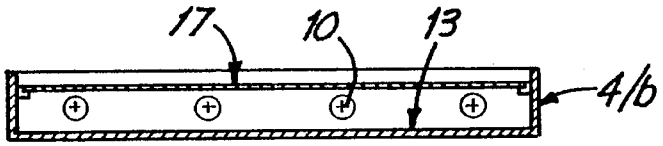
FIG. 10 is a cross-sectional view of a fourth preferred embodiment of the light emitting panel taken along line b—b as shown in FIG. 7.
Figure 11:
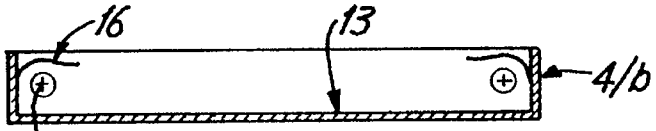
FIG. 11 is a cross-sectional view of a fifth preferred embodiment of the light emitting panel taken along line b—b as shown in FIG. 7.

The electric current may be fed in the traditional manner or electronically. The emitted light may be used:

a) in a direct manner (shown in FIGS. 8, 9 and 10), whereby:
   - in FIGS. 8 and 10 the inner bottom 13 of the panel may be rendered more or less reflective (in FIG. 8 "mirrors" 14 arranged along the edges at an angle of 45° which will improve the luminosity along the periphery of the panel);
   - in FIG. 9 a plurality of parabolas 15 diffuse and reflect light in a more uniform way;

b) in an indirect manner (shown in FIG. 11), whereby the parabolas 16 direct the light towards the reflecting bottom 13.

Other solutions may consist in coating with a luminescent layer on the inner wall of the closing cover or the box-like inner wall.

In order to obtain colored light, there may exist different solutions:

- to use colored tubes 10–12 with known configurations; even those partly of one color and partly of a different color;
- to use white light tubes 10–12, and a cover 9 obtained from transparent colored plastic material; and
- to use tubes 10–12 emitting white light, a white and transparent cover 9, a colored and transparent plate 17 interposed between the cover and the tubes (shown in FIG. 10), the plate being replaceable in case it is desired to change over to another coloring;

The gradual variation of the light intensity is obtained by known "regulators" which are controlled manually or connected to photoelectric cells which automatically adjust the luminosity of the panel so as to adapt it to the luminosity of the environment.

Figure 16:
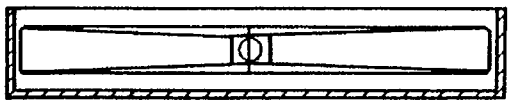
FIG. 16 is a side cross-sectional view of the light emitting panel, taken along line d—d as shown in FIG. 15.
Figure 15:
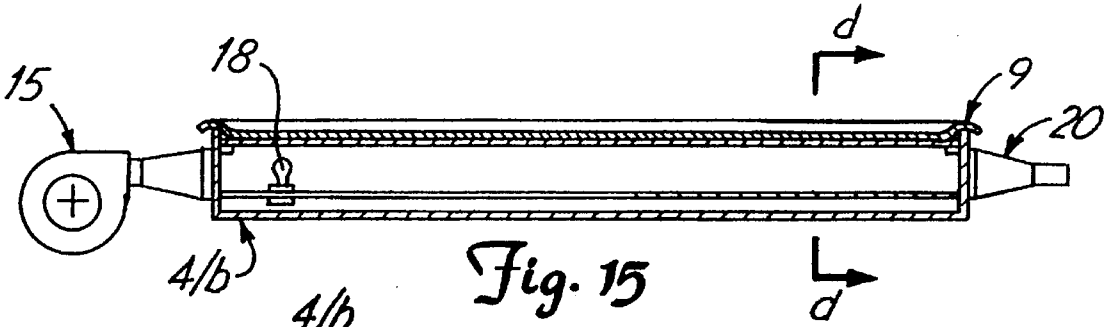
FIG. 15 is a side cross-sectional view of the light emitting panel, taken along line c—c as shown in FIG. 14.
Figure 14:
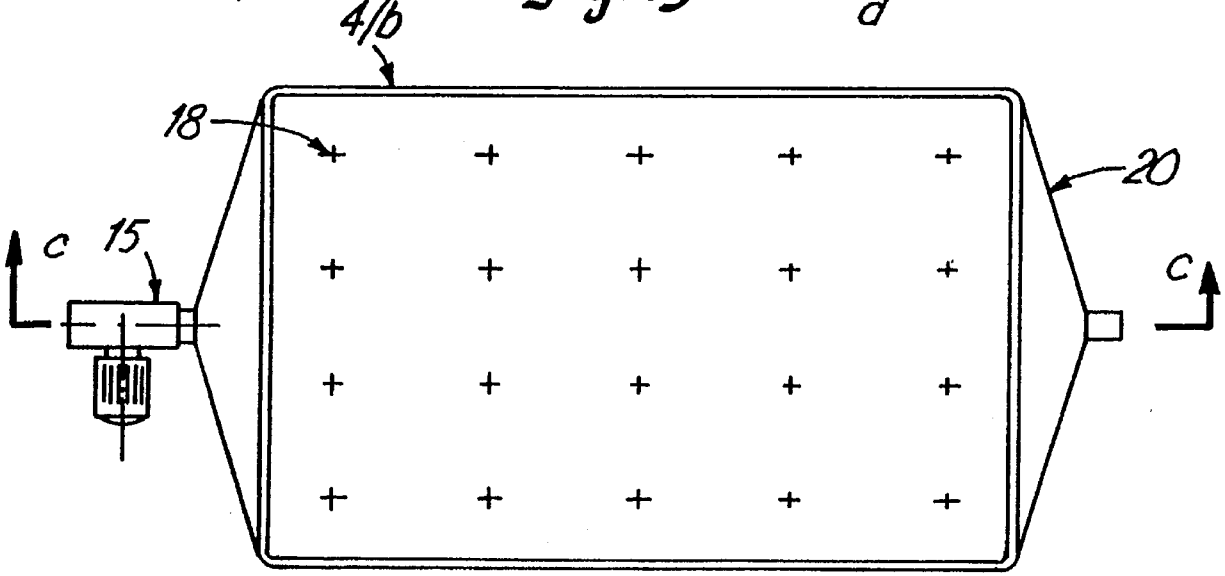
FIG. 14 is a top plan view of an embodiment of the light emitting panel of the present invention, which uses electric bulbs and in which a ventilator is provided in order to generate an air flow which is heated by the heat radiated by the electric bulbs and may be used for drying up the animal.
Figure 17:
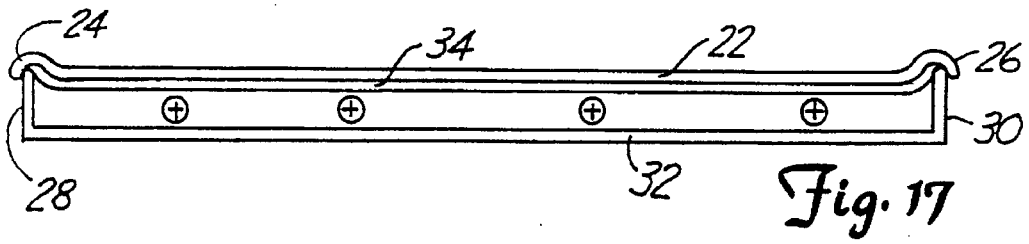
FIG. 17 is a cross-sectional view of a preferred embodiment of the cover of the present invention, including a cover with a luminescent coating.
Figure 18:
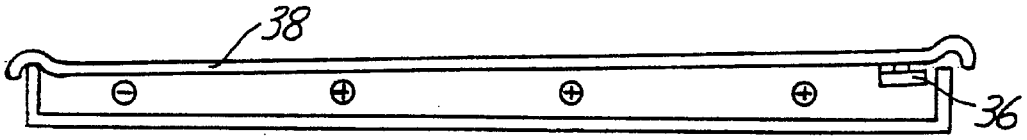
FIG. 18 is a cross-sectional view of a preferred box-like structure of the present invention, including a microswitch for disconnecting power to the light emitting source when the cover is removed.
Figure 19:
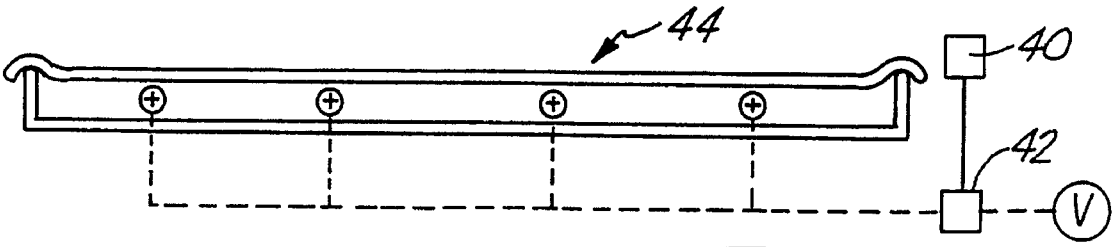
FIG. 19 is a partially schematic cross-sectional view of a preferred box-like structure of the present invention, showing a photoelectric cell provided for adjusting an intensity of light emitted from the device in response to an intensity of light in the environment.

A second possible embodiment is shown in FIGS. 14, 15 and 16. In this embodiment all what has already been said remains valid except that the light emitting source consists of electric bulbs 18 or halogen lamps (quartz-iodine lamps); i.e. means which produce heat. In this embodiment, to the box-like part 4/*b* there is assembled a motor-driven ventilator or turbine 19; the air produced by it is heated by the glow lamps or electric bulbs 18; it is collected by the hood 20 onto which a hose is inserted (not shown) which ends into a frusto-conical sleeve collar used as a "phon" in order to dry up and to treat the animal.

In both embodiments there are provided one or more outlets for the insertion of the plug of an electrical shearing machine (clipper) or any other electrical device used by the operators. Obviously, the invention is not limited to the constructive details which have been shown and/or described, but it comprises all those variants and equivalent forms which are realized on the basis of the present inventive concept. We believe that also a table with fixed or adjustable height, provided with an usual non-luminous plane, is also included in the scope of the present invention, provided it comprises drawers, doors, electric outlets, and possibly cable wrappings, even if these additional features are singularly known and within the scope of one skilled in the art, since in our specific field they are new, if taken together, and their common use has never been suggested in the state of the art. The invention may be sold in the following forms:

- fixed height table with incorporated light-emitting panel;
- table with an adjustable height, comprising an incorporated light-emitting panel;
- a single light-emitting panel to be laid on a table of every type whatever;

a table with an usual plane, i.e. non-luminous, which is fixed or adjustable in height, the table comprising drawers, doors, electric outlets and possibly a wrapping for a cable.

Although the present invention has been described with reference to the preferred embodiments, workers skilled in the art will recognize that changes may be made in form and detail without departing from the spirit and scope of the invention.

What is claimed is:

1. A table with a light emitting plane for the treatment of pets, comprising:

a water-proof box-like structure having outer edges and light reflective properties;

a light emitting source positioned within the box-like structure;

means for coloring light;

means for reflecting and diffusing light;

means for varying an intensity of light emitted from the device;

a single piece removable cover, supported by an upper surface of the box-like structure, having a tray-like shape, and having edges extending beyond the outer edges of the box-like structure, wherein the shape and position of the edges of the cover relative to the edges of the box-like structure prevent liquid from entering the box-like structure;

a shaped supporting structure mounted to the box-like structure which support the box like structure, light emitting source, means for coloring light, means for reflecting and diffusing light and removable cover;

at least one electrical cable, electrically connected to the light emitting source;

a device for winding the electrical cable, mounted to the supporting structure;

and an electric circuit for supplying electric current to the light emitting source, wherein the means for reflecting and diffusing light comprises a plurality of parabolic shaped reflectors positioned within the box-like structure which reflect light, and further comprising a microswitch means positioned on an upper surface of the box-like structure, actuated by removal of the cover, for interrupting the electric current.

2. A table according to claim 1, wherein said light emitting source comprises a plurality of white light tubes and wherein the means for coloring light comprises a cover made of a transparent colored plastic material.

3. A table according to claim 1, wherein said cover is white and transparent in color, wherein said light emitting source comprises a plurality of white light tubes, and wherein the means for coloring light comprises a transparent colored plate mounted in the box-like structure between the white light tubes and the white transparent cover, said plate being replaceable with a plate of a different color.

4. A table according to claim 3, wherein the means for coloring light comprises a layer of a luminescent substance applied to an inner surface of the cover.

5. A table according to claim 1, wherein the means for coloring light comprises a transparent plate mounted in the box-like structure between the light emitting source and a lower surface of the single piece removable cover, wherein the plate comprises a layer of a luminescent substance applied to a major surface of the transparent panel.

6. A table according to claim 1, and further comprising at least one hinge, wherein said removable cover is pivotally attached to the box-like structure by means of the hinge.

7. A table according to claim 1, wherein the means for reflecting and diffusing light comprises a selected arrangement of lamps mounted within the box-like structure.

8. A table according to claim 1, wherein the means for coloring light comprises at least one screen mounted in the box-like structure.

9. A table according to claim 1, wherein the means for coloring light comprises at least one colored filter mounted in the box-like structure.

10. A table according to claim 1, wherein the means for coloring light comprises a plurality of fluorescent tubes, each having a delicate color, wherein each fluorescent tube is mounted within the box-like structure.

11. A table according to claim 1, wherein the means of reflecting and diffusing light comprises a plurality of diffusing surfaces mounted within the box-like structure, wherein each surface has a plurality of shaded zones and inclined zones.

12. A table according to claim 1, wherein the means for reflecting and diffusing light comprises a plurality of reflecting surfaces mounted within the box-like structure, wherein the surfaces are selected from the group consisting of: metal, marble, corrugated material, bronze coated and aluminum coated.

13. A table according to claim 1, wherein the means for reflecting and diffusing light is formed of a material selected from the group consisting of: frosted glasses, milk glasses, opal glasses, wrinkled and prismatic glasses.

14. A table according to claim 1, wherein the means for varying an intensity of light emitted comprises a photoelectric cell having an eye mounted on the support structure which gradually adjusts a luminosity of the panel in response to a luminosity of the environment.

15. The device of claim 1, and further comprising means for adjusting a height of the table.

16. The device of claim 1, and further comprising at least one drawer, the drawer mounted for sliding engagement with the support structure.

17. The device of claim 1, and further comprising at least one door mounted to the shaped support structure, each door having a hinge located on a first side of the door for pivotal attachment to the support structure.

18. A table with a light emitting panel, comprising:

a housing having outer edges, a first opening for receiving air, and a second opening for removing heated air, and a base, wherein the second opening is equipped with a hose fitting;

a light source supported by the base of said housing consisting of at least one heat generating lamp;

a single piece, waterproof removable cover, wherein the removable cover is positionable on an upper surface of the housing, wherein the cover has a tray-like shape and edges extending beyond the outer edges of the housing, and which permits the passage of light;

a ventilator for drawing air into said housing through said first opening and for producing an air flow through said housing;

a hose having a first end for connecting to the hose fitting, and a second opposite end, and further comprising a frusto-conical sleeve collar mounted to the second opposite end; and a means for conveying the heated air through the hose, whereby the heated air is utilized as a hair drier.

* * * * *